US009751545B2

(12) United States Patent
Steffen, II et al.

(10) Patent No.: US 9,751,545 B2
(45) Date of Patent: Sep. 5, 2017

(54) SYSTEMS AND METHODS FOR TESTING WAYSIDE UNITS

(71) Applicant: General Electric Company, Schenectady, NY (US)

(72) Inventors: Michael Steffen, II, Melbourne, FL (US); Jeffrey Fries, Lee's Summit, MO (US); Aric Albert Weingartner, Lee's Summit, MO (US); Jesse Herlocker, Melbourne, FL (US)

(73) Assignee: ALSTOM TRANSPORT TECHNOLOGIES, Saint-Quen (FR)

( * ) Notice: Subject to any disclaimer, the term of this patent is extended or adjusted under 35 U.S.C. 154(b) by 779 days.

(21) Appl. No.: 14/146,882

(22) Filed: Jan. 3, 2014

(65) Prior Publication Data

US 2014/0365160 A1 Dec. 11, 2014

Related U.S. Application Data

(60) Provisional application No. 61/833,085, filed on Jun. 10, 2013.

(51) Int. Cl.

| | |
|---|---|
| ***B61L 29/30*** | (2006.01) |
| ***B61L 27/00*** | (2006.01) |
| *B61L 29/22* | (2006.01) |

(52) U.S. Cl.

CPC ..... *B61L 27/0055* (2013.01); *B61L 29/22* (2013.01)

(58) Field of Classification Search

USPC ..... 701/2, 20; 246/473.1

See application file for complete search history.

(56) References Cited

U.S. PATENT DOCUMENTS

| | | | | |
|---|---|---|---|---|
| 6,824,110 | B2 | 11/2004 | Kane | |
| 7,089,093 | B2 | 8/2006 | Lacote | |
| 7,966,126 | B2 | 6/2011 | Willis | |
| 8,214,091 | B2 | 7/2012 | Kernwein | |
| 8,406,940 | B2 | 3/2013 | Otsubo | |
| 2009/0177344 | A1 | 7/2009 | James | |
| 2009/0198391 | A1* | 8/2009 | Kumar | B60L 3/12 701/2 |
| 2011/0084176 | A1 | 4/2011 | Reichelt | |

* cited by examiner

*Primary Examiner* — Lam Nguyen

(74) *Attorney, Agent, or Firm* — Christopher R. Carroll; The Small Patent Law Group, LLC

(57) ABSTRACT

A system includes a communication module and an analysis module. The communication module is configured to be operably connectable to a wayside unit of a transportation network and to transmit a simulation message to the wayside unit. The simulation message simulates at least one of a request or command from at least one transportation network element corresponding to a wayside action to be performed by the wayside unit. The simulation message is configured to elicit a wayside message from the wayside unit upon receipt of the simulation message. The analysis module is configured to obtain the wayside message and to provide a display corresponding to the wayside message.

8 Claims, 3 Drawing Sheets

SYSTEMS AND METHODS FOR TESTING WAYSIDE UNITS

RELATED APPLICATIONS

This application claims priority to U.S. Provisional Application Ser. No. 61/833,085, filed 10 Jun. 2013, and entitled "Systems And Methods For Testing Wayside Units," the content of which is hereby incorporated by reference in its entirety.

FIELD

Embodiments of the subject matter described herein relate to testing of wayside units associated with transportation networks.

BACKGROUND

A vehicle transportation system may include routes over which vehicles travel. These routes may cross routes of other transportation systems, such as road or highway systems over which automobile traffic may pass. Further, different routes (and/or portions of routes forming sub-routes of a given route) may cross each other or be linked to allow for crossings. Wayside units may be disposed alongside routes to monitor routes for potential occupancy of the routes, to provide information and/or commands to vehicles in conjunction with vehicle control systems (e.g., Positive Train Control or PTC systems), operate highway crossings, or the like. For example, to warn automobiles and/or pedestrians, crossing gates may be provided at locations where rail tracks intersect roads, with the crossing gates configured to warn motorists and inhibit automobiles from crossing the tracks while a rail vehicle is traveling on the tracks at or near the crossing.

To ensure proper setup and/or continued operation, as well to trouble-shoot or analyze a unit or units that have functioned improperly, wayside units may need to be tested. As a wayside unit may generally be configured to communicate with a vehicle system, performing a test of the wayside unit may require use of a vehicle to utilize the onboard systems of the vehicle, and may require use of onboard software, an external time sync server, a radio router, and a radio, for example. Such testing may be inconvenient, expensive, and/or time consuming, and may occupy valuable route and/or vehicle resources during testing.

BRIEF DESCRIPTION

In an embodiment, a system includes a communication module and an analysis module. As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

The communication module is configured to be operably connectable to a wayside unit of a transportation network and to transmit a simulation message to the wayside unit. The simulation message simulates at least one of a request or command from at least one transportation network element corresponding to a wayside action to be performed by the wayside unit. The simulation message is configured to elicit a wayside message from the wayside unit upon receipt of the simulation message. The analysis module is configured to obtain the wayside message and to provide a display corresponding to the wayside message.

In an embodiment, a method includes developing a simulation message configured to simulate at least one of a request or command from at least one transportation network element for a wayside action to be performed by a wayside unit. The simulation message is configured to elicit a wayside message from the wayside unit upon receipt of the simulation message. The method also includes transmitting, from a communication module of a testing system, the simulation message to the wayside unit. Also, the method includes receiving, at the communication module, the wayside message from the wayside unit. Further, the method includes providing a display corresponding to the wayside message.

In an embodiment, a tangible and non-transitory computer readable medium includes one or more computer software modules configured to direct one or more processors to develop a simulation message that is configured to simulate at least one of a request or command from at least one transportation network element for a wayside action to be performed by a wayside unit, with the simulation message configured to elicit a wayside message from the wayside unit upon receipt of the simulation message; transmit the simulation message to the wayside unit. The one or more computer software modules also are configured to direct the one or more processors to receive the wayside message from the wayside unit and provide a display corresponding to the wayside message.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
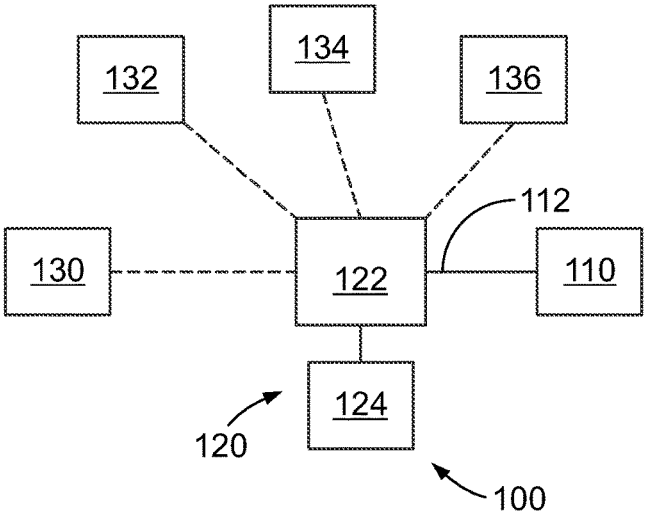
FIG. 1 is a schematic view of a transportation network and testing system in accordance with an embodiment.

One or more embodiments of the inventive subject matter described herein provide systems and methods for improved testing of wayside equipment. In various embodiments, a testing system is provided that operably connects with wayside equipment to facilitate testing of the wayside equipment without requiring the use or participation of vehicles or other elements (e.g., other wayside equipment) of a transportation network. For example, a personal computer (PC) may be configured as a testing system that connects to a wayside station, as one example, via a hardwired connection, or, as another example, via a remote network connection, such as an internet connection. In various embodiments, the wayside station may be configured to communicate with an onboard system configured to control movement of a vehicle (e.g., a rail vehicle) and/or to control equipment associated with a crossing (e.g., track detection equipment, crossing warning systems, switches, or the like). The control systems for the rail vehicle, for example, may be configured to be compatible with Positive Train Control (PTC) systems utilized in the United States. For example, bidirectional communications between onboard equipment and wayside equipment may be used to communicate information between the rail vehicle and the wayside equipment and/or to activate and deactivate crossing warning (or closing) systems. In various embodiments, a testing system may be employed to transmit simulated messages (e.g., messages configured to appear as emanating from a rail vehicle) to wayside equipment, and evaluate the response of the wayside equipment to the simulated message. Testing systems may be employed on-site (e.g., with the wayside equipment positioned and installed along a transportation route) or off-site (e.g., in a lab or shop where wayside equipment is manufactured, assembled, inspected before installation, repaired, refurbished, or the like). Further testing systems may be employed that connect directly to wayside equipment (e.g., via a hard-wired connection) or that connect remotely (e.g., via the internet).

In various embodiments, a testing system provides a simulated message used to evaluate a wayside equipment module or system. The testing system may be employed to one or more of investigate a past event or past operation of the wayside equipment, trouble-shoot the wayside-equipment, initially clear, certify, or approve a piece of wayside equipment for use in the field, or perform routine or periodic testing of wayside equipment. The testing system may simulate a message sent from an element of a transportation network (e.g., a vehicle), and the simulated message may be configured to elicit a status and/or response message from the wayside equipment. The testing system may be configured to receive the status and/or response message and to display the message (or a modified version thereof). The operation of the wayside equipment may be monitored by analyzing the displayed message.

Additionally or alternatively, the operation of the wayside equipment may be tested or monitored by an examination of an action performed by the wayside equipment or under the control of the wayside equipment responsive to receipt of the simulated message (or by analysis of a corresponding output of the wayside equipment, such as a signal configured to be received by a functional device from the wayside equipment), a status or other display provided by the wayside equipment (e.g., a status or display not included as part of the status and/or response message), or the like. For example, the wayside equipment may be configured as a remote crossing module configured to operate crossing warning equipment. The testing system may transmit a simulated message calling for a given performance of an activity by the crossing warning equipment. For instance, the simulated message may call for a lowering of a gate and activation of a visual warning (e.g., flashing lights) at a given time. After the wayside equipment receives the simulated message, the wayside equipment may be observed to confirm that the called for activity (e.g., the lowering of the gate, initiation of flashing lights, or the like) occurs at the predetermined time. As another example, the wayside equipment may be tested off-site, where the wayside equipment may not be operably connected to the crossing warning equipment. After the wayside equipment receives the simulated message, an output or outputs of the wayside equipment may be monitored to confirm that an appropriate signal configured to be received by the crossing warning equipment and to cause activation of the crossing warning equipment has been transmitted and/or that the crossing warning system has been activated.

A technical effect of embodiments includes improved convenience in testing of wayside equipment. A technical effect of embodiments includes improved accuracy and efficiency of wayside equipment testing. A technical effect of embodiments includes reduced cost of testing wayside equipment. A technical effect of embodiments includes reduced downtime of vehicles and/or other aspects of transportation networks for wayside equipment testing. A technical effect of embodiments includes improved accuracy of testing or verifying wireless crossing messages and/or status or acknowledgement messages sent responsive to wireless crossing messages. A technical effect of embodiments includes improved ease of setup of wayside equipment including remote crossing modules such as crossing modules configured to receive wireless crossing messages. A technical effect of embodiments includes increased coverage of testing.

Throughout this document, the term vehicle consist may be used. A vehicle consist is a group of any number of vehicles that are mechanically coupled to travel together along a route. A vehicle consist may have one or more propulsion-generating units (e.g., vehicles capable of generating propulsive force, which also are referred to as propulsion units) in succession and connected together so as to provide motoring and/or braking capability for the vehicle consist. The propulsion units may be connected together with no other vehicles or cars between the propulsion units. One example of a vehicle consist is a locomotive consist that includes locomotives as the propulsion units. Other vehicles may be used instead of or in addition to locomotives to form the vehicle consist. A vehicle consist can also include non-propulsion generating units, such as where two or more propulsion units are connected with each other by a non-propulsion unit, such as a rail car, passenger car, or other vehicle that cannot generate propulsive force to propel the vehicle consist. A larger vehicle consist, such as a train, can have sub-consists. Specifically, there can be a lead consist (of propulsion or non-powered control units), and one or more remote consists (of propulsion or non-powered control units), such as midway in a line of cars and another remote consist at the end of the train. The vehicle consist may have a lead propulsion unit and a trail or remote propulsion unit. The terms "lead," "trail," and "remote" are used to indicate which of the propulsion units control operations of other propulsion units, and which propulsion units are controlled by other propulsion units, regardless of locations within the vehicle consist. For example, a lead propulsion unit can control the operations of the trail or remote propulsion units, even though the lead propulsion unit may or may not be disposed at a front or leading end of the vehicle consist along a direction of travel. A vehicle consist can be configured for distributed power operation, wherein throttle and braking commands are relayed from the lead propulsion unit to the remote propulsion units by a radio link or physical cable. Toward this end, the term vehicle consist should be not be considered a limiting factor when discussing multiple propulsion units within the same vehicle consist.

FIG. 1 is a schematic view of a transportation network 100 in accordance with an embodiment. The transportation network 100 depicted in FIG. 1 includes a wayside testing unit 110, a wayside unit 120, and a number of network elements configured to be communicatively coupled to the wayside unit 120. One or more of the various elements may further be configured to be communicatively coupled to other elements in addition to the wayside unit 120. The various network elements may include one or more of a rail vehicle 130, an information unit 132, a second wayside system 134, a vital remote 136, or the like. For example, the information unit 132 may be configured to transmit global positioning system (GPS) information to one or more other elements of the network.

Generally, the wayside unit 120 is configured to receive a message or messages from other elements of the transportation network 100 (and/or simulated messages from the wayside testing unit 110) and, responsive to receipt of such message or messages, to send an acknowledgement or status message (or messages). In various embodiments, the wayside unit 120 may be configured as or include a wayside interface unit (WIU) that is configured to send messages to elements of the transportation network such as vehicles, other wayside equipment, or the like. In various embodiments, messages sent by the WIU may be configured as wayside status messages (WSM) used in conjunction with a positive train control (PTC) system.

In the illustrated embodiment, the wayside unit 120 includes a wayside module 122 and a functional device 124. The wayside module 122 is configured to be communicatively coupled with other elements (e.g., rail vehicle 130, second wayside system 134, or the like) of the transportation network 100, and also to control or operate the functional device 124. As an example, the functional device 124 may be a crossing warning system including one or more of a gate, light display, audible alarm, or the like. The wayside module 122 may be configured to activate the crossing warning system as appropriate based on the approach of rail vehicles toward a crossing associated with the crossing warning system. For example, the wayside module 122 may receive wireless crossing messages from the rail vehicle 130, and control the crossing warning system using the received wireless crossing messages. In various embodiments, the wayside module 122 may be configured to control other or additional functional devices to perform additional or alternative physical activities or tasks. Further additionally or alternatively, the wayside module 122 may be configured to receive messages from elements of the transportation network 100 other than the rail vehicle 130 (e.g., the second wayside system 134, the vital remote 136, or the like) that request, order, or otherwise call for performance of a physical activity (or inhibition of a physical activity).

In the illustrated embodiment, the wayside testing unit 110 is configured to communicatively couple via a direct connection 112 to the wayside unit 120. The direct connection 112 may be configured, for example, as a hardwired connection. The hardwired connection may be a detachable hardwired connection, and include a plug or other interface. In various embodiments, the wayside testing unit 110 may be configured to communicatively couple with the wayside unit 120 via a wireless connection. Alternatively or additionally, the wayside testing unit 110 may be configured to communicatively couple to the wayside unit 120 remotely, for example over an internet connection. As one example, the wayside testing unit 110 and the wayside unit 120 may each include a respective Ethernet port configured to couple to the internet.

The illustrated wayside testing unit 110 is configured to simulate a message from one or more other elements (e.g., one or more of the rail vehicle 130, information unit 132, second wayside unit 134, or vital remote 136) of the transportation network 100, and to one or more of monitor, observe, log, display, analyze or the like the response of the wayside unit 120 to receiving the simulated message. For example, the simulated message may be configured to direct, request, or otherwise elicit a response or acknowledgement message from the wayside unit 120. The acknowledgement message, for example, may include portions describing or depicting settings or statuses of the wayside unit 120 that have been set responsive to the simulated message. The wayside testing unit 110 may be configured to analyze all or a portion of the acknowledgement message to confirm that the statuses or settings are set correctly, and/or to identify any statuses or settings that are not correctly set. Additionally or alternatively, the wayside testing unit 110 may be configured to display all or a portion of the acknowledgment message. Displaying a message may be understood as providing a visual and/or audible indication corresponding to all or a portion of the message. For example, the message as sent may be displayed on a screen. As another example, a filtered message (e.g., with portions not of interest removed) may be shown on a screen. Additionally or alternatively, the acknowledgement message may be translated or otherwise modified prior to display. For example, the message may be sent in one or more of a binary, numeric, or alphanumeric code organized in a predetermined format and various statuses or settings corresponding to the predetermined format may be displayed in a plain language equivalent (e.g., "timer on," "crossing inhibited," "crossing activated," or the like.) In various embodiments, the wayside testing unit 110 may include one or more of a screen, speaker, or light to display a message or an indication of whether the message is correct or not. Further, the display may be provided in real time and/or may be stored for display at a later time.

In various embodiments, the wayside testing unit 110 may compare all or a portion of the acknowledgement message (or a modified acknowledgement message) to an expected message corresponding to an acknowledgment message that would be received when the wayside unit 120 is functioning properly. For example, various statuses may be included in an acknowledgement message as formatted by a mapping file. The mapping file, for example, may describe the order or format of particular statuses to be included in a message. The wayside testing unit 110 may individually develop an expected message (e.g., based on one or more statuses formatted in accordance with a mapping file), and compare one or more statuses conveyed or communicated by the acknowledgement message received from the wayside unit 120, and identify any differences. Further, in various embodiments, the wayside testing unit 110 may include or have access to a trouble-shooting database. The trouble-shooting database, for example, may include identified issues and/or solutions tabulated against corresponding discrepancies of statuses. Any discrepancies of statuses between the expected message and the received acknowledgment message may then be identified and corresponding issues and/or solutions may be determined using the trouble-shooting database.

In various embodiments, the wayside testing unit 110 may be configured as a generally portable or otherwise readily transportable unit. For example, the wayside testing unit in some embodiments may be configured as a personal computer (PC) such as a laptop PC. In various embodiments, the wayside testing unit 110 may be connected or coupled to the wayside unit 120 in the field or on-site. In various embodiments, the wayside testing unit 110 may be connected or coupled to the wayside unit 120 off-site, such as in a lab or shop.

In addition to analysis of the acknowledgement message by an observer viewing a display and/or by an appropriately programmed or configured analysis module of the wayside testing unit 110, the operation of the wayside unit 120 and/or any equipment controlled by the wayside unit 120 may also be analyzed or observed. For example, the wayside unit 120 may provide an output signal configured to cause a specific action by a functional module (e.g., lower a gate, start a flashing light display, or the like). Such a signal may be monitored after transmitting the simulated message to evaluate the wayside unit 120. As one example, the wayside unit 120 may be configured to start a timer responsive to a particular simulated message. An acknowledgment message may include a status describing or depicting whether the timer was sent, but may not demonstrate that the timer is actually working or at what time the timer will expire. In such an example scenario, an output or display of the wayside unit 120 may be obtained or observed to confirm the proper operation of the timer, and/or a physical activity corresponding to the expiration of the timer (e.g., lowering of a gate at a specified time) may be observed to confirm proper operation of the timer. Thus, in various embodiments, an output or display of the wayside unit 120 may be used to confirm an initial analysis made based on examination of an acknowledgment or status message, and/or an output or display of the wayside unit 120 may be used to provide supplemental information or data regarding the operation of the wayside unit 120.

As another example, the functional module may be operably connected to the wayside unit 120, and the behavior of the functional module may be observed or analyzed to evaluate the performance of the wayside unit 120 responsive to receipt of the simulated message. Further, the wayside unit 120 may be evaluated using a simulated message configured to inhibit performance of an action or physical activity. For example, the simulated message may include an inhibit command, and the wayside unit 120 may be evaluated by confirming one or more statuses have been properly set to a setting corresponding to an inhibit mode, and/or it may be confirmed that the action or physical activity does not occur.

Figure 2:
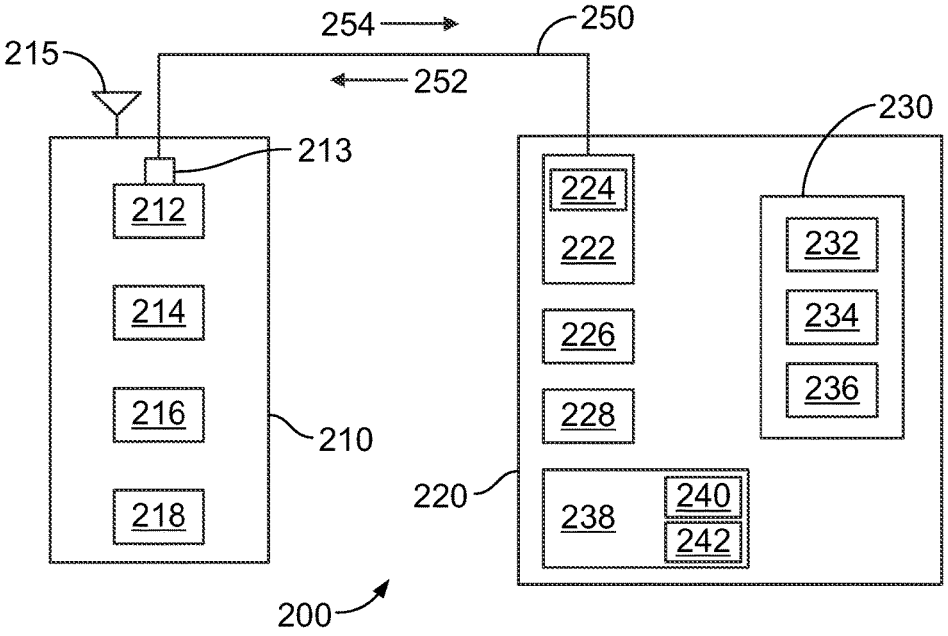
FIG. 2 is a schematic view of a testing system in accordance with an embodiment.

FIG. 2 is a schematic view of a wayside equipment testing system 200 in accordance with one embodiment. The wayside equipment testing system 200 includes a testing module 220 configured for use in conjunction with a wayside unit 210. The testing module 220 may be configured as an independent or self-contained unit that may be temporarily coupled to the wayside unit 210. In various embodiments, the testing module 220 may be configured as all or a portion of a personal computer (PC) such as a laptop. Thus, the testing module may be readily transportable for use on-site at plural field locations. The testing module 220 is configured to be operably connected to the wayside unit 210, to transmit a simulated message (e.g., a message simulated to resemble a message ordinarily transmitted to the wayside unit 210 by a vehicle or other element of a transportation network) to the wayside unit 210, and to display and/or analyze an acknowledgement or status message transmitted by the wayside unit 210 responsive to receipt of the simulated message. In various embodiments, the testing module 220 and the wayside unit 210 may be operably connected for evaluation of the wayside unit 210 on-site (e.g., at a field installation for which the wayside unit 210 is configured for intended operation) or in a lab, shop, or other off-site location (e.g., a location where the wayside unit 210 is manufactured, assembled, repaired, inspected, or the like). The wayside unit 210 may be understood to be performing pursuant to an "intended operation" when the wayside unit 210 is performing the function(s) for which the wayside unit 210 is expected or designed to perform given the associated inputs into the wayside unit 210.

In the illustrated embodiment, the wayside unit 210 includes a communication module 212, an activity control module 214, a functional module 216, and a display 218. The wayside unit 210 may be configured, for example, as a remote crossing module configured to one or more of lower a gate, activate lights, or sound a bell or other alarm. In various embodiments, the wayside unit 210 may be configured to receive a message corresponding to a crossing activity (e.g., activation or inhibition of a crossing warning activity) from a rail vehicle, and to perform a corresponding crossing activity using information from the message. The wayside unit 210 may also be configured to provide information and/or control instructions pursuant to a PTC scheme to rail vehicles traveling through a transportation network.

The communication module 212 may be configured to receive messages from one or more network elements (e.g., rail vehicles, vital remotes, other wayside units, a central dispatch station, or the like) and/or to transmit messages to one or more network elements. In various embodiments, the communication module 212 may be configured to one or more of receive messages, transmit messages, pre-process information or data received in a message, format information or data to form a message, decode a message, decrypt or encrypt a message, compile information to form a message, extract information from a message, or the like. In the illustrated embodiment, the communication module 212 includes a port 213. The port 213, for example, may be configured as an Ethernet port. In various embodiments, the port 213 may be configured for one or more hardwired and/or wireless connections. For example, the port 213 may be configured for wireless communication (e.g., via the antenna 215) with one or more rail vehicles or other elements of a transportation network, as well as configured for a hard-wired connection with the testing module 220. In the illustrated embodiments, the wayside unit 210 is depicted as coupled to the testing module 220 via a hardwired connection 250. In various embodiments, the wayside unit 210 may be communicatively coupled to the testing module 220 wirelessly and/or remotely.

In various embodiments, each wayside unit may have a unique identifier and/or address as well as a unique mapping file for arranging, constructing, or developing messages (e.g., a specific order for various predetermined statuses to be included in various messages sent responsive to different types of incoming messages). Messages to and/or from a wayside unit may be sent under one or more protocols, such as edge message protocol (EMP), Class D messaging, or the like.

In the illustrated embodiment, the activity control module 214 is configured to determine appropriate activities to be performed by the functional module 216, and to control the functional module 216 to perform the activities. For example, in various embodiments, the activity control module 214 may be configured to receive track detection information from a track detection system and/or receive wireless messages from one or more rail vehicles corresponding to the approach of one or more vehicles to a crossing. Using the received information, the activity control module may determine an appropriate time at which to activate a warning system (e.g., an arrival time adjusted by a predetermined warning period), and control a warning crossing system to activate at the appropriate time.

The functional module 216 depicted in FIG. 2 is configured to perform an activity. For example, the functional module 216 may be associated with a crossing and be configured to lower a gate, start a flashing light sequence, sound a bell or other alarm, or the like to impede traffic by motorists through a crossing or warn against crossing over one or more tracks of a rail transportation network. In the illustrated embodiment, the functional module 216 acts under the control of the activity control module 214. In various embodiments, the functional module 216 may be part of an integral unit including the activity control module 214 and/or the communication module 212, or, in other embodiments, may be a separate component or system that is configured to be operably coupled to the activity control module 214.

In the illustrated embodiment, the display 218 is configured to provide an indication of one or more statuses, settings, and/or activities to be undertaken by the wayside unit 210 or under the control of the wayside unit 210. The information provided by the display 218 may be duplicative of or supplemental to information that may be provided as part of an acknowledgment message transmitted by the communication module 212. For example, the display 218 may be configured to include a screen configured to display a countdown corresponding to a timer that has been set during a test, whereas the status message may only indicate whether the timer is active or not. The display 218, in various embodiments, may include a screen, indicator light, or speaker configured to provide an indication corresponding to an activity to be performed responsive to receipt of the simulated message. In various embodiments, the display 218 may be temporarily coupled to the wayside unit 210. For example, the display 218 may be coupled to the wayside unit 210 (e.g., in addition to or in lieu of connection of the functional module 216) during a testing or validation procedure but not coupled to the wayside unit 210 during intended operation of the wayside unit 210.

The testing module 220 of the embodiment depicted in FIG. 2 includes a communication module 222, a memory module 226, a filter module 228, an analysis module 230, and a set-up module 238. In various embodiments, the testing module 220 is configured to prepare a simulation message 252 that simulates a message sent from an element (e.g., vehicle) of a transportation network to the wayside unit 210. The testing module 220 is also configured to receive a wayside message 254 sent from the wayside unit 210 responsive to receipt of the simulation message 252. The wayside message 254 may be, for example, an acknowledgment or status message. Further, the testing module 220 is configured to one or more of parse, modify, display, or analyze the received message 254. For example, the message 254 may be configured using predetermined message protocol settings, for example as specified or set forth by a mapping file corresponding to a given wayside unit. The testing module 220 may utilize the mapping file to parse the message 254. The mapping file may be unique for each individual wayside module, and the testing module 220 may store or otherwise have access to the mapping file for each individual wayside module. The testing module 220 may also be configured to act as a time sync server for the wayside unit 210. For example, the testing module 220 may support one or more of simple network time protocol (SNTP), edge message protocol (EMP), or the like.

The communication module 222 is configured to facilitate communication with the wayside unit 210 (or other network element to be tested, monitored, or evaluated). In various embodiments, the communication module 222 may be configured to one or more of receive messages, transmit messages, pre-process information or data received in a message, format information or data to form a message, decode a message, decrypt or encrypt a message, compile information to form a message, extract information from a message, or the like. In the illustrated embodiment, the communication module 222 may include a connection port 224 configured to accommodate one or more of wireless, remote, or hardwired connections. The connection port 224, for example, may include one or more Ethernet ports.

Generally, in various embodiments, the communication module 222 is configured to be operably connectable to the wayside unit 2100, and to transmit a simulation message 252 to the wayside unit 2100 (e.g., via the hardwired connection path 250). The simulation message 252 is configured to simulate at least of a request or command from a transportation network element (e.g., a rail vehicle, wayside module other than the wayside unit 210, vital remote, GPS unit, or the like). The request or command corresponds to a wayside action to be performed by the wayside unit 210. A wayside action as used herein may be understood, for example, as a physical activity or task to be performed using the wayside unit 210 (e.g., under the control of the wayside unit 210). The physical activity or task may be an activity or task to be performed in connection with the operation of a transportation network. For example, the activity or task may relate to the operation of a crossing warning. In various embodiments, the wayside action may include one or more of mechanically translating or moving an object (e.g., raising or lowering a gate), operating a visual display (e.g., providing a flashing light display), providing an audible noise (e.g., sounding a bell or alarm), or the like. For purposes of clarity and avoidance of doubt, it may be noted that wayside action as used herein does not include, for example, mere transmission of a message or signal to a rail vehicle, or, as another example, activation of a communication beacon. The request or command may correspond to the wayside action by calling for the performance of the physical activity, or, as another example, by calling for the inhibition or suppression of the physical activity otherwise called for. Further, the simulation message 252 is configured to elicit a wayside message 254 from the wayside unit upon receipt of the simulation message.

The wayside message 254 may be an acknowledgement or status message, and may include or describe statuses of various settings or parameters, equipment, or components set responsive to the simulated message. Examples of wireless crossing statuses that may be included in the wayside message 254 and/or the simulation message 252 may relate to whether or not a track detection system indicates an upcoming activation of a crossing warning, whether or not a vehicle has indicated an appropriate upcoming activation of a crossing warning, whether an inhibit request has been transmitted or is pending, whether one or more devices are armed, whether or not a station release request has been transmitted, whether or not a gate release request has been transmitted, or the like. In various embodiments, additional examples of wireless crossing statuses that may be included in the wayside message 254 and/or the simulation message 252 include Crossing Health (indicates to vehicle whether a crossing is healthy, whether a crossing should be traversed at a speed corresponding to an unhealthy condition, or the like), Crossing Active (indicates to the vehicle whether or not the crossing warning is active), Wireless Activation (indicates to the vehicle whether or not the crossing is enabled for wireless crossing activation), or High Speed OK (indicates whether or not the crossing is available to be activated by a vehicle traveling above a normal or reference crossing speed). Examples of parameters that may be communicated may relate or correspond to, for example, an amount of time to activate a warning prior to the vehicle reaching a crossing, an amount of time a vehicle is expected to stop at a station, minimum gate release time, network or vehicle identification information, identification of a mode or type of vehicle, values for timers and/or timeout periods, location information for a crossing, range information for a track detection system, or the like.

In various embodiments, the communication module may be configured to transmit plural simulation messages concurrently (e.g., partially or entirely overlapping over a temporal period). The plural simulation messages may simulate messages from corresponding plural elements of the transportation network. For example, multiple messages may be simulated to simulate the transmission of message from plural rail vehicles approaching a crossing along different tracks. Thus, individual messages and/or responses may be tested as well as the ability of the wayside unit 210 to distinguish between and/or prioritize among different requests or commands received from plural sources. As just one example, a first simulated message may include an inhibit message targeted for a specific track. The receipt of the first simulated message may be tested by analyzing a corresponding status of a wayside message. A second simulated message may include a request for a crossing activation on a different track, and the ability of the wayside to ignore the inhibit request and act upon the crossing activation request may be monitored or evaluated. In various embodiments, the plural simulation messages may be configured, arranged, and/or transmitted using automated message sequencing. The automation of the message sequencing may be, as one example, time based, or, as another example, event based. The simulation messages may be prepared or developed concurrently with an ongoing test of a wayside unit by a testing system or unit.

The memory module 226 may include a memory accessible by other modules or aspects of the testing module 220. In various embodiments, the memory module may include one or more database, log files, or the like. For example, connection profiles for particular wayside units may be stored in the memory module, with each connection profiles including connection settings tailored for a particular wayside unit. The connection profiles may be utilized to ensure quick connection to a given wayside unit. Further, mapping files corresponding to particular wayside units may be stored in the memory module 226, and, for example, accessed by one or more other aspects of the testing module 220 to parse or translate a message from a given wayside unit. Alternatively or additionally, the memory module 226 may be utilized to store one or more logs. For example, messages sent and received over time may be collected in a log (e.g., a log that updates in real time), and displayed as a group and/or saved to a file to capture multiple days of data. In various embodiments, the size of one or more log files may be generally limited only by the size of a hard drive or other storage component(s) on a PC utilized as the testing module 220. With enough memory, months of logged data may be saved. It should be noted that additional logs (e.g., for additional wayside units and/or additional periods of time) may be saved on memory devices external to the testing module 220 and accessed as appropriate. In various embodiments, the memory module 226 may be configured to store message statistics to help users trouble shoot problems. Such statistics may include statistics corresponding to valid vs. invalid EMP, HMAC, and Class D messages sent from the wayside unit 210, and/or statistics regarding Time Syncing and/or simulation messages. In various embodiments, the memory module 226 may include one or more data bases configured for the correlation of specific discrepancies between logged or identified messages from messages corresponding to intended operation, with the data bases used for troubleshooting (e.g., identifying issues experienced by a wayside unit and/or identifying potential solutions or remedies).

In the illustrated embodiment, the filter module 228 is configured to obtain the message 254 received from the wayside unit 210, and to remove portions of the message 254 not of interest to a given evaluation or analysis and/or to modify (e.g., translate) one or more portions of the message 254. The filter module 228 may be configured to provide a modified message (e.g., modified by one or more of filtering, translating, or the like) to other portions or aspects of the testing module 220. For example, the filter module 228 may provide a modified message for display to an operator or user and/or to another module (e.g., the analysis module 230) of the testing module 220 for further analysis. Thus, in some embodiments, the filter module 228 may be configured to remove or modify a portion of a wayside message to provide a modified wayside message, which may then be displayed, for example, using the analysis module.

For example, the filter module 228 may remove a header or other identification information from the wayside message 254 so that only statuses included in the wayside message 254 are displayed. As another example, if only one or more statuses are of interest in a test or simulation being performed, then the filter module 228 may remove the statuses not of interest so that only the statuses of interest are displayed. For example, the filter module 228 may be configured to separate out one or more portions of message corresponding to a given PTC device (or devices) and a rule evaluation for the given device (or devices), thereby allowing users to evaluate the correctness of a message at a glance without having to parse out the message by hand to analyze the content. The filter module 228, for example, may separate out specific information such as a device name, a rule name or number corresponding to meaning of a status, or the like.

Further, a wayside message 254 may be compared (e.g., by the analysis module 230) to an expected message corresponding to operation as intended, and the filter module 228 may be configured to display only those aspects of the message 254 that differ from the expected message. Further, the filter module 228 may be configured to translate all or a portion of the message 254 from a first format to a second format. For example, the filter module 228 may parse or de-code the message 254 (e.g., using a mapping file) to provide a plain-language (e.g., English) equivalent. For example, instead of providing a message in an original format in which the message was transmitted, a modified message may be used to provide a display on the screen such as "Timer On," "Crossing Activity Suppressed," "Crossing Activation Set for [a specified time]," or the like. Thus, a user or operator may not be required to sift through large amounts of undesired and/or difficult to comprehend data, and an easily understandable display may be provided. Additionally or alternatively to filtering or modifying individual messages (or groups of messages), the filter module 228 may be configured to filter, modify, or otherwise process data logs as well.

The analysis module 230 of the depicted embodiment includes a message development module 232, a troubleshooting module 234, and a display module 236. Generally, in various embodiments, the analysis module 230 is configured to obtain the wayside message 254 (or a modified version of the wayside message 254 obtained, for example, from the filter module 228), and to perform an analysis or evaluation of the message (e.g., autonomously) and/or to provide a display corresponding to the message (e.g., to an operator viewing a screen).

In the illustrated embodiment, the message development module 232 is configured to develop an original simulation message (e.g., the message 252) to be transmitted to the wayside unit 210. The simulation message may be configured to mimic, resemble, or otherwise simulate a message from a vehicle (or other element of a transportation network such as a vital remote or other wayside equipment), with the message calling for a physical activity to be performed by or under the control of the wayside unit 210. For example, in some embodiments the message development module 232 may select, identify, or determine a message to be simulated, for example, based on a predetermined testing protocol. As another example, a message to be simulated may be specified by operator input. In various embodiments, an operator may select a task that may be performed (or inhibited) by the wayside unit 210 from a pull-down menu, or, as another example, by entering a task name or identifier via a keyboard.

After a desired task (or tasks) request to be simulated has been determined, the message development module prepares a simulation message (e.g., the message 252) that will be transmitted to the wayside unit 210. For example, the message development module 232 may translate a request specified as a plain-language request (e.g., "inhibit crossing warning for track D," "request station release for track B," or the like) into a format that will be comprehended by the wayside unit 210, for example in a format specified by a mapping file configured for the wayside unit 210.

In various embodiments, the message development module 232 may also develop an expected message corresponding to the simulation message. For example, the expected message may form a portion or all of a wayside message expected to be returned by the wayside unit 210 responsive to receipt of the message 252 when the wayside unit 210 is functioning as intended or according to design. In some embodiments, the expected message may be constructed according to a mapping file, while in other embodiments, the expected message may specify the values for one or more statuses, but not be formatted according to a mapping file. The testing module 220 may use the expected message to identify potential issues with the wayside unit 210 based on any discrepancies in the message 254 provided by the wayside unit from the expected message. For example, the testing module 220 (e.g., the troubleshooting module 234 discussed herein and/or other aspect or portion of the analysis module 230) may compare the message or messages provided by the wayside unit 210 responsive to the expected message. If the messages were the same (or within a predetermined amount or range of similarity), then the wayside unit 210 may be considered as passing a test. If the message were not similar enough, then the wayside unit 210 may be designated for further analysis, modification, repair, or the like.

In the illustrated embodiment, the analysis module 230 also includes a troubleshooting module 234. The troubleshooting module 234 is configured to analyze a received wayside message (e.g., the wayside message 254) to identify potential issues and/or solutions for the wayside unit 210. For example, the troubleshooting module 234 may use identified differences between a received message and an expected message to identify issues and/or solutions corresponding to previous experiences characterized by similar discrepancies in messages (e.g., in statuses specified in messages). The troubleshooting module 234 may utilize a database correlating known issues and/or solutions to discrepancies or characteristics of messages (e.g., a database residing in the memory module 226) to identify issues and/or solutions for the wayside unit 210.

The analysis module 230 depicted in FIG. 2 also includes a display module 236. In the illustrated embodiment, the display module 236 is configured to provide a visual and/or audible display corresponding to a wayside message. For example, the display may include all or a portion of the wayside message and/or a modified wayside message. As another example, the display may include a description or depiction of one or more statuses conveyed by a wayside message. Additionally or alternatively, the display may provide information corresponding to an evaluation or analysis performed by the analysis module 230, such as a comparison of all or a portion of the wayside message to an expected message, an indication of any differences between the wayside message and an expected message, results of a troubleshooting analysis (e.g., a list or other identification of potential issues and/or solutions with the wayside unit 210), or the like. Further still, the display module 236 may be configured to display invalid messages and identify them as invalid. For example, a message that is invalid due to an invalid configuration CRC or invalid HMAC may be displayed, allowing an operator to determine that a communication channel is working even if there is a setting causing the messages to be invalid. The display module 236 may include one or more of a screen, light, speaker, or the like. In some embodiments the display module 236 may be configured as an integral sub-module of the testing module 220 (e.g., as a portion of the analysis module 230), while in other embodiments the display module 236 may be separate or removable from the testing module 220.

The set-up module 238 depicted in FIG. 2 includes a guide module 240 and a connection module 242. Generally, in various embodiments, the set-up module 238 is configured to guide an operator through a set-up procedure for operably connecting the testing module 220 to the wayside unit 210. The set-up procedure may be configured for a particular location for which the wayside unit 210 is intended. Based on the physical location of the wayside unit 210 and the specific number and configuration of tracks associated therewith, each wayside unit may have a unique mapping file and unique identifier. Thus, messages for use in conjunction with a particular wayside unit, along with any additional connection setting unique to or appropriate for a given wayside unit, may be provided by the set-up module 238 (e.g., in conjunction with the memory module 226). For example, for an initial connection between a testing module and a wayside unit (e.g., where a testing module has not been utilized with a given wayside unit previously), the set-up module 238 may be configured to provide step-by-step guidance to assist an operator in specifying the correct settings or otherwise configuring the testing module and wayside unit for operable connection.

As another example, the set-up module 238 may be configured to identify any wayside units previously connected to the testing module 220 and provide the correct connection settings. Additionally or alternatively, the set-up module 238 may provide a list of wayside units (e.g., a pull-down list) from which an operator may select an appropriate wayside unit (e.g., by unique name, location, or other identifier), and the testing module 220 may utilize the connection settings corresponding to the selected wayside unit. Further still, in various embodiments, the set-up module 238 may provide an integrated system help guide configured to assist an operator in setting up the testing module 220, using the testing module 220, troubleshooting the testing module 220 or an associated wayside unit, or the like. In various embodiments, the set-up module 238 may be configured so that the testing module 220 defaults to settings used the last time the testing module was used. Additionally or alternatively, the set-up module 238 may act to verify a wayside unit or permit communication with a wayside unit, for example by ensuring that a correct configuration cyclic redundancy check (CRC) is used. In the illustrated embodiment, the guide module 240 is configured to provide one or more interactive guides for use by an operator and the connection module 242 is configured to guide or control connection of the testing module 220 to the wayside unit 210 (e.g., selecting or setting connection settings, performing authentication checks, or the like). In various embodiments, connection profiles may be stored, for example in the memory module 226. Each connection profile may describe or otherwise correspond to one or more connection settings for a particular wayside unit.

As discussed, above, in various embodiments, a wayside equipment module may be configured as a remote crossing module configured to operate a crossing warning system. A more detailed example of such a crossing warning system and commands or messages utilized by such a crossing warning system that may be simulated by a testing system are discussed in connection with FIG. 3.

Figure 3:
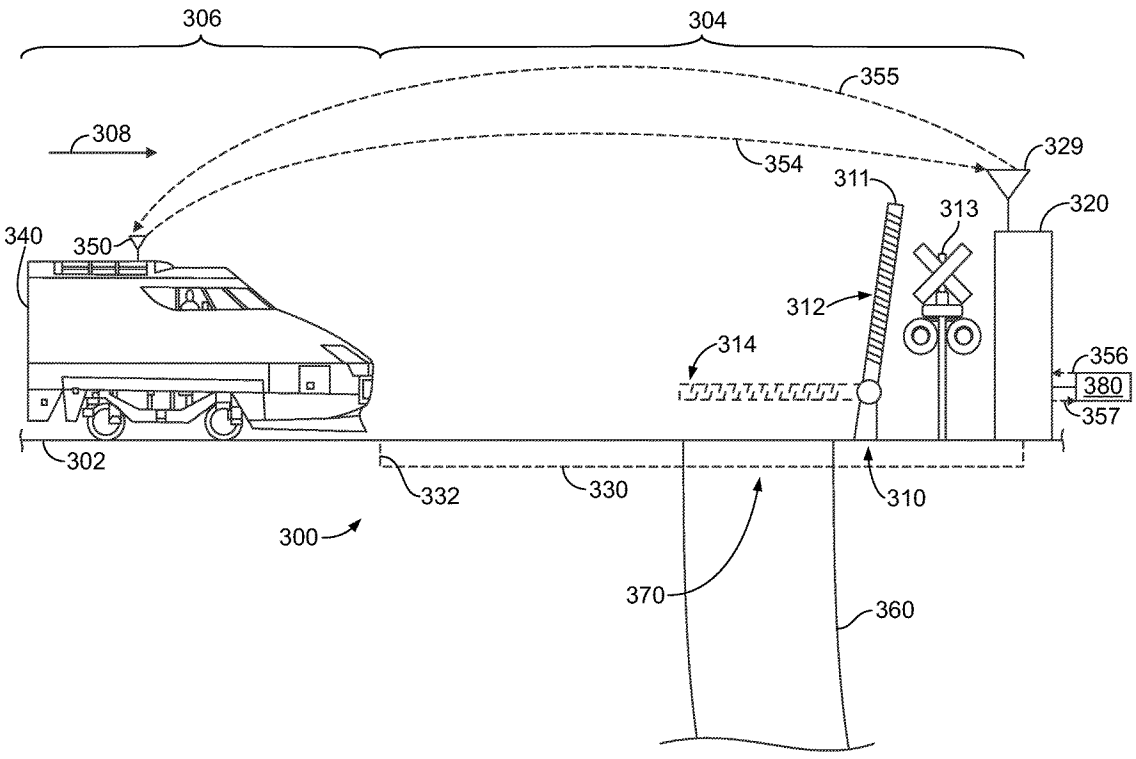
FIG. 3 is a schematic view of a transportation network and testing system in accordance with an embodiment.

FIG. 3 depicts a schematic view of a transportation network 300 in accordance with an embodiment. The system 300 includes a crossing warning system 310, a remote crossing module 320, a track detection system 330, a vehicle system 340, and a testing module 380. In the embodiment depicted in FIG. 3, the vehicle system 340 is shown traveling over a first route 302 in a direction 308 toward a crossing 370. The crossing 370 corresponds to intersection of the first route 302 with a second route 360. The first route 302, for example, may be configured as a railroad track over which a rail vehicle may travel. The second route 360 in the illustrated embodiment is a road or highway that is paved, leveled, or otherwise configured for automobile and/or truck travel. In some embodiments, the crossing may be understood as a "highway crossing at grade."

For clarity and ease of depiction, only one vehicle system 340 and one track along the first route 302 are shown in FIG. 3. However, it should be noted that, in various embodiments, the transportation network 100 may include plural vehicle systems, plural sub-routes of the first route 302, and/or plural crossings. For example, in some embodiments, the transportation network 300 and/or remote crossing module 320 may be configured to monitor 16 rail vehicles and 12 crossings disposed along four different sub-routes of the first route 302. Further still, different types of rail vehicles (e.g., configured for different control system capabilities) may be utilized. For example, some vehicles may be legacy or previous generation vehicles, while other vehicles may be more recent vehicles with additional capabilities. The transportation network 300 and the remote crossing module 320 may be configured to communicate with each type of vehicle, and the testing system 380 may be configured to simulate messages from each type. Also, the testing module 380 is depicted as connected on-site to the remote crossing module 320. Additionally or alternatively, the testing module 380 may be connected remotely (e.g., via an internet connection) or may be connected to the testing module 380 off-site in a shop or lab.

The crossing warning system 310 and the remote crossing module 320 are associated with and disposed proximate the crossing 370. The crossing warning system 310 and the remote crossing module 320 are configured to impede access through the crossing 370 via the second route 360 (e.g., paved road accessible to automobiles) when the vehicle system 340 passes by or through the crossing 370 along the first route 302 (e.g., rail system).

The track detection system 330 depicted in FIG. 3 has an effective range 304. In FIG. 3, the vehicle system 340 is depicted in a territory 306 outside of the effective range 304 and moving in direction 308 toward the crossing 370 and toward entering the effective range 304 of the track detection system 330. In FIG. 3, the range 304 is depicted for ease of illustration as extending in one direction (e.g., to the left of the crossing as seen in FIG. 3), but it should be understood that the range 304 may also extend in the opposite direction (e.g., to the right of the crossing as seen in FIG. 3) to provide for traffic detection in multiple directions.

In various embodiments, the track detection system 330 may be configured as a crossing predictor system. Crossing predictors may be used to attempt to determine a time of arrival at a crossing by a vehicle. Known crossing predictor systems may use alternating current (AC) track circuits to determine the rate of change of impedance in an area of track near a crossing. In some circumstances, crossing predictor systems do not function properly, for example when a relatively large amount of electrical interference is present, such as electrical interference present in electrified systems. In such electrified systems, vehicles such as trains may be powered by AC or direct current (DC) power provided by an overhead catenary, third rail, or the like. The currents provided to power the vehicles may exceed hundreds or thousands of amperes, and are much larger than currents used by crossing predictor systems. The large difference in signal amplitudes between the electrification currents used to power vehicles and the currents used for crossing predictors may make it difficult to separate the signals when the electrification and predictor currents are shared on the same rail conductors or in close proximity to each other. Further, interference frequencies from the electrification currents may, for example, cause activation via crossing predictors when no vehicles are present, leading to confused motorists and/or motorists evading crossing gates or engaging in other unsafe behavior. Thus, in some embodiments, electrified systems may employ occupancy detection circuits or systems. Such occupancy detection track circuits may detect the presence of a train or other vehicle along a route within a given distance of a crossing, but do not detect or determine information corresponding to a more precise position and/or speed of a vehicle.

It should be noted that FIG. 3 is schematic in nature and intended by way of example. In various embodiments, various aspects or modules may be omitted, modified, or added. Further, various modules, systems, or other aspects may be combined. Yet further still, various modules or systems may be separated into sub-modules or sub-systems and/or functionality of a given module or system may be shared between or assigned differently to different modules or systems.

The depicted crossing warning system 310 is configured to impede travel through the crossing 370 along the second route 360 when the crossing warning system 310 is activated. The crossing warning system 310, when activated, may provide one or more of an audible warning (e.g., bell), visible warning (e.g., flashing lights), and/or a physical barrier (e.g., gate). In the illustrated embodiment, the crossing warning system 310 includes a gate 311 that may be raised to an open position 312 to allow traffic through the crossing 370 along the second route 360 or lowered to a closed position 314 to impede traffic through the crossing 370 along the second route 360. The depicted crossing warning system 310 also includes a crossing warning indicator 313 configured to provide a visual and/or audible indication. In various embodiments, the crossing warning indicator 313 may include one or more of lights, bells, or the like. In some embodiments, as used herein, impeding travel along a particular route may not present an absolute bar to travel along the route. For example, travel along a route may be impeded by warning against travel through a crossing, discouraging travel through a crossing, blocking travel through a crossing, instructing against travel through a crossing, or otherwise inhibiting travel through a crossing. For instance, the gate 311 may be placed in the closed position 314 to impede the passage of traffic through the crossing 370 along the second route 360; however, a motorist may attempt to evade the gate 311 by driving around the gate 311.

In the illustrated embodiment, the remote crossing module 320 is disposed along the route 302 along which the vehicle 340 is configured to travel proximate to the crossing 370. The remote crossing module is operably connected to the crossing warning system 310 and is configured to operate the crossing warning system 310 to allow traffic through the crossing 370 along the second route 360 when no vehicles are traversing through the crossing 370 along the first route 302 (or are within a specified time and/or distance of the crossing 370), and to impede traffic through the crossing 370 along the second route 360 when a vehicle is traversing through the crossing 370 along the first route 302 (or is within a specified time and/or distance of the crossing 370). The remote crossing module 320 may operate the crossing warning system 310 based on instructions or information received from one or more of the vehicle system 340 or the track detection system 330. For example, the remote crossing module 320 may be configured to impede travel along the second route 360 using information obtained from the track detection system 330. The remote crossing module 320 may be operably coupled to and receive information from the track detection system 330, and may operate the crossing warning system 310 using information from the track detection system 330. The track detection system 330 (and/or the remote crossing module 320) in conjunction with the track detection system 330) may be configured to send an electrical signal into a track (e.g., route 302) and receive or detect a signal corresponding to an occupancy or activity on the track.

In the illustrated embodiment, the remote crossing module 320 is configured to wirelessly receive messages from and/or transmit messages to the vehicle system 340 via the antenna 329. In alternate embodiments, the remote crossing module 320 and the vehicle system 340 may be configured to communicate over different media, such as over one or more rails of the transportation system 300.

The remote crossing module 320 is configured to communicate messages or information with the vehicle system 340. The remote crossing module 320 may be configured to one or more of receive messages, transmit messages, preprocess information or data received in a message, format information or data to form a message, decode a message, decrypt or encrypt a message, compile information to form a message, extract information from a message, or the like. In the illustrated embodiment, the remote crossing module 320 utilizes the antenna 329 to communicate with the vehicle system 340 (e.g., via the antenna 350 of the vehicle system 340). For example, during normal or intended operation, the remote crossing module 320 may receive a message 354 transmitted from the vehicle system 340. In various embodiments, the message 354 may be transmitted before the vehicle system enters the range 304 and may include information corresponding to one or more of a time to activate the crossing warning system 310, suppression of an activation of the crossing warning system 310 indicated by the track detection system 330, or identification of a subroute upon which the vehicle system 340 is traveling.

Further, during normal or intended operation, the remote crossing module 320 may transmit a message 355 to the vehicle system 340 responsive to the receipt of the message 354. During testing, the remote crossing module 320 may transmit a message 357 responsive to the receipt of a simulated message 356. In various embodiments, the remote crossing module 320 may not be aware or informed of whether the remote crossing module 320 is communicating with the vehicle system 340 or the testing system 380. Additionally, the testing system 380 in the illustrated embodiment is configured to simulate the message 354 (e.g., as the simulated message 356) and to receive the message 357, allowing for testing of the remote crossing module 354 without requiring the use of the vehicle system 340.

The message 354 (and/or the simulated message 356) transmitted to the remote crossing module 320 may pertain to one or more activities to be performed (or suppressed) by the remote crossing module 320. By way of example, in the illustrated embodiments, the message 354 and/or the simulated message 356 may be configured to instruct or direct the remote crossing module 320 to perform (or control the performance of) a physical activity regarding the activation of the crossing warning system 110. For example, the message 354 may be configured as one or more of a crossing start request message, a crossing disarm request message, a crossing inhibit message, a crossing inhibit release message, or a crossing station release request message. Similarly, the simulated message 356 may be configured to simulate one or more of a crossing start request message, a crossing disarm request message, a crossing inhibit message, a crossing inhibit release message, or a crossing station release request message.

As one example of the message 354 (or simulated message 356), a crossing start request message, for example, may be sent by the vehicle system 340 (or simulated by the testing system 380) to inform the remote crossing module 320 the time at which the vehicle system 340 expects to reach the crossing 370 and/or to clear the crossing. The time sent may be configured as a relative time (e.g., a time from a given event, such as reception of a message), or as an absolute time (e.g., a time synchronized to a common high precision reference system. An absolute time may be understood as a time specified in accordance with a synchronization scheme where other entities use the same scheme. For example, clocks associated with and/or accessible by both the vehicle system 140 and the remote crossing module 120 may be synchronized via a common precision time reference such as a time provided by a global positioning system (GPS) or Network Time Protocol (NTP). In contrast to an absolute time, a relative time may be understood as a time described with reference to a particular event (e.g., 30 seconds from a time of receiving a message, 20 seconds from a time of receiving a message, or the like). The message may also identify a particular vehicle and/or particular track associated with the crossing start request. The remote crossing module 320, upon receipt of a crossing start request, may determine a time to activate (e.g., lower a gate, begin a flashing light display, sound a bell or alarm, or the like) the crossing warning system 310 based on the expected time of arrival. For example, if a 30 second warning period is desired, the remote crossing module 320 may activate the crossing warning system 310 30 seconds before the time of arrival provided by the vehicle system 340.

After a simulated start request message (e.g., as part of the simulated message 356) is transmitted to the remote crossing module 320, the remote crossing module 320 may be tested in one or more of a variety of ways. For example, one or more aspects (e.g., a status or other portion of the payload of the message 357) of the received message 357 may be reviewed by an operator using a display of the testing system 380 and/or by an analysis module of the testing system. As another example, if the crossing warning system 310 is operably connected to the remote crossing module 320, the crossing warning system 310 may be observed to confirm proper performance of a specified activity or activities at a given time. For instance, in various embodiments, the remote crossing module 320 may be observed to confirm that a gate is lowered and that lights and alarms are started 30 seconds before the arrival time specified in the simulated message 356. As still another example, if the crossing warning system 310 is not operably connected to the remote crossing module 320 (e.g., if the remote crossing module 320 is located off-site for testing or initialization), a display or output of the remote crossing module 320 may be analyzed. For instance, one or more outputs corresponding to the activity called for (e.g., a signal that would otherwise be sent to the crossing warning system 310 when connected) may be analyzed to confirm proper operation. It may be noted that, in some embodiments, the crossing start request message (or a related message) may also serve to direct or instruct the remote crossing module 320 to disregard or override an indicated activation of the crossing warning system 310 indicated by information from the track detection system 330 for the particular track on which the sending vehicle is disposed. For example, if a sending vehicle is traveling at a relatively slow speed, a crossing warning may be activated for an overly long period of time if a track detection system is used to determine activation time instead of a time provided by the vehicle.

As another example of the message 354 (or simulated message 356), a crossing disarm request message, for example, may be sent by the vehicle system 340 (or simulated by the testing system 380) to inform the remote crossing module 320 of a cancellation of an activation of the crossing warning system 310 for a particular vehicle on a particular track. The remote crossing module 320, upon receipt of a crossing disarm request, may identify a corresponding crossing start request previously received (e.g., identify a pending start request corresponding to the same track and/or vehicle as the disarm request), and cancel the corresponding crossing start request previously pending.

After a simulated disarm request message (e.g., as part of the simulated message 356) is transmitted to the remote crossing module 320, the remote crossing module 320 may be tested in one or more of a variety of ways. For example, one or more aspects (e.g., a status or other portion of the payload of the message 357) of the received message 357 may be reviewed by an operator using a display of the testing system 380 and/or by an analysis module of the testing system 380 to confirm that the start request has been cancelled. As another example, if the crossing warning system 310 is operably connected to the remote crossing module 320, the crossing warning system 310 may be observed to confirm that the crossing warning system 310 is not activated at the previously specified or determined time. As still another example, if the crossing warning system 310 is not operably connected to the remote crossing module 320 (e.g., if the remote crossing module 320 is located off-site for testing or initialization), a display or output of the remote crossing module 320 may be analyzed. For instance, one or more outputs corresponding to the activity called for (e.g., a signal that would otherwise be sent to the crossing warning system 310 when connected) may be analyzed to confirm proper operation (e.g., that the output corresponds to non-activation of the crossing warning system).

As another example of the message 354 (or simulated message 356), a crossing inhibit message, for example, may be sent by the vehicle system 340 (or simulated by the testing system 380) to inform the remote crossing module 320 of an upcoming stop at a station within range of the track detection system 330 for a particular vehicle on a particular track. For example, if a vehicle stops at the station after a crossing warning has been activated, the crossing warning may remain activated (resulting in overly long warning times and inconvenience to motorists), or the crossing warning may be activated and de-activated without a vehicle passing the crossing (resulting in confusion to motorists and/or premature wear of crossing warning system components). Accordingly, the vehicle system 340 may transmit an inhibit request to prevent activation of the crossing warning system 310 while the vehicle system 340 is approaching a station at which a stop will be made or during such a stop. The remote crossing module 320, upon receipt of a crossing inhibit request, may prevent activation of the crossing warning system 310 otherwise called for by information from the track detection system 330 for a given track. Also, the remote crossing module 320 may initiate an inhibit timeout period. If an additional inhibit request is not received before the inhibit timeout period expires, the inhibit status may be changed from active to inactive.

After a simulated inhibit request message (e.g., as part of the simulated message 356) is transmitted to the remote crossing module 320, the remote crossing module 320 may be tested in one or more of a variety of ways. For example, one or more aspects (e.g., a status or other portion of the payload of the message 357) of the received message 357 may be reviewed by an operator using a display of the testing system 380 and/or by an analysis module of the testing system to confirm that the inhibit request has been received, that the system will not be activated based upon track detection information for a particular track, that the inhibit status is active, that an inhibit timeout timer is active, or the like. As another example, if the crossing warning system 310 is operably connected to the remote crossing module 320, the crossing warning system 310 may be observed to confirm that the crossing warning system 310 is not activated at the previously specified or determined time when the inhibit status is active. As still another example, if the crossing warning system 310 is not operably connected to the remote crossing module 320 (e.g., if the remote crossing module 320 is located off-site for testing or initialization), a display or output of the remote crossing module 320 may be analyzed. For instance, one or more outputs corresponding to the activity called for (e.g., a signal that would otherwise be sent to the crossing warning system 310 when connected) may be analyzed to confirm proper operation (e.g., that the inhibit timeout period has been commenced, that the inhibit status is changed to inactive if a subsequent inhibit request is not received before the expiration of the timeout period, or the like).

As another example of the message 354 (or simulated message 356), a crossing inhibit release message, for example, may be sent by the vehicle system 340 (or simulated by the testing system 380) to inform the remote crossing module 320 of a cancellation of a crossing inhibit request for a particular vehicle on a particular track. The remote crossing module 320, upon receipt of a crossing inhibit release request, may identify a corresponding crossing inhibit request previously received (e.g., identify a pending inhibit request corresponding to the same track and/or vehicle as the disarm request), and cancel the corresponding crossing inhibit request previously pending.

After a simulated crossing inhibit release request message (e.g., as part of the simulated message 356) is transmitted to the remote crossing module 320, the remote crossing module 320 may be tested in one or more of a variety of ways. As just one example, one or more aspects (e.g., a status or other portion of the payload of the message 357) of the received message 357 may be reviewed by an operator using a display of the testing system 380 and/or by an analysis module of the testing system to confirm that the inhibit request has been cancelled.

In various embodiments, the testing system 380 may also be configured to test the remote crossing module 310 to confirm if the remote crossing module is properly prioritizing and/or granting precedence to various requests. For example, a first request having a lower priority may be simulated from a first simulated or virtual vehicle, and a second request having a higher priority may be simulated from a second simulated or virtual vehicle, and the remote crossing module 320 (and/or a message sent therefrom) analyzed to confirm that the proper priority or precedence has been assigned and acted upon. In one example scenario, a crossing request is simulated from a first source and an inhibit request is simulated from a second source. The crossing start request in the example scenario has a higher priority than the inhibit request, and thus the inhibit request should be ignored, negated, over-ridden or the like. After the simulated messages have been sent, a message from the remote crossing module 320 (e.g., one or more portions of a payload corresponding to statuses) may be analyzed, a display of the remote crossing module 320 may be reviewed, and/or the behavior of the remote crossing module 320 (and/or equipment associated therewith and under the control of the remote crossing module 320) may be observed to confirm that the crossing start request has been appropriately acted upon and that the inhibit request has been ignored or negated. The above example scenario provides but one example of testing of potentially conflicting or inconsistent commands sent from plural vehicles or elements of a transportation network. Other messages or priorities may be tested in various other embodiments.

As another example of the message 354 (or simulated message 356), a crossing station release message, for example, may be sent by the vehicle system 340 (or simulated by the testing system 380) to inform the remote crossing module 320 of an upcoming departure from a station within range of the track detection system 330 for a particular vehicle on a particular track. For example, if a vehicle departs from a station located within the range of the track detection system 330 for which activation has been inhibited, the vehicle may arrive at the crossing before the full warning time has been provided if the station is located relatively close to the crossing. Accordingly, the vehicle system 340 may transmit a station release request to help insure the crossing activation has been provided for the desired warning time before the vehicle arrives at the crossing. For example, the remote crossing module 320, upon receipt of a crossing station release request, may activate the crossing warning system 310 as well as determine a permissible departure time for the vehicle from the station (and/or a permissible arrival time at the crossing). The remote crossing module 320 may then transmit the permissible arrival (or departure) time to the vehicle, for example as part of the message 354. A control system of the vehicle may then enforce the permissible departure time to prevent premature (e.g., before a specified warning time) arrival at the crossing.

After a simulated station release request message (e.g., as part of the simulated message 356) is transmitted to the remote crossing module 320, the remote crossing module 320 may be tested in one or more of a variety of ways. For example, one or more aspects (e.g., a status or other portion of the payload of the message 357) of the received message 357 may be reviewed by an operator using a display of the testing system 380 and/or by an analysis module of the testing system to confirm that the station release request has been received, that the crossing warning system has been activated or will be activated at an appropriate time, that the departure time has been determined, that the departure time has been or will be transmitted, or the like. As another example, if the crossing warning system 310 is operably connected to the remote crossing module 320, the crossing warning system 310 may be observed to confirm that the crossing warning system 310 is activated at the appropriate time. As still another example, if the crossing warning system 310 is not operably connected to the remote crossing module 320 (e.g., if the remote crossing module 320 is located off-site for testing or initialization), a display or output of the remote crossing module 320 may be analyzed.

It may be noted that the messages 355 and 357 (e.g., acknowledgement or status messages from a wayside unit) may include one or more of a general acknowledgement message, a specific acknowledgment corresponding to a specific requested action or status configuration, or the like. Additionally or alternatively, the messages 355 and 357 may include information such as information describing a setting for a timing (e.g., a warning timing for a crossing, a dwell timing at a station, or the like), location information corresponding to location of a wayside unit, crossing warning system, or the like, information corresponding to occupancy or statuses of tracks or sub-routes of a transportation network, or the like. As another example, a message (e.g., a message from a GPS or other information unit or a corresponding simulation message) may include differential correction information.

Messages may also include information or commands corresponding to a PTC system (e.g., block occupancy information, speed limits or orders, or the like). For example, in various embodiments, information regarding track occupancy, status of switches, or other information utilized, for example, in conjunction with a positive control system may be exchanged between the remote crossing module 320 and the vehicle system 340. A positive train control system may be understood as a system for monitoring and controlling the movement of a rail vehicle such as a train to provide increased safety. A train, for example, may receive information about where the train is allowed to safely travel, with onboard equipment configured to apply the information to control the train or enforce control activities in accordance with the information. For example, a positive train control system may force a train to slow or stop based on the condition of a signal, switch, crossing, or the like that the train is approaching.

Figure 4:
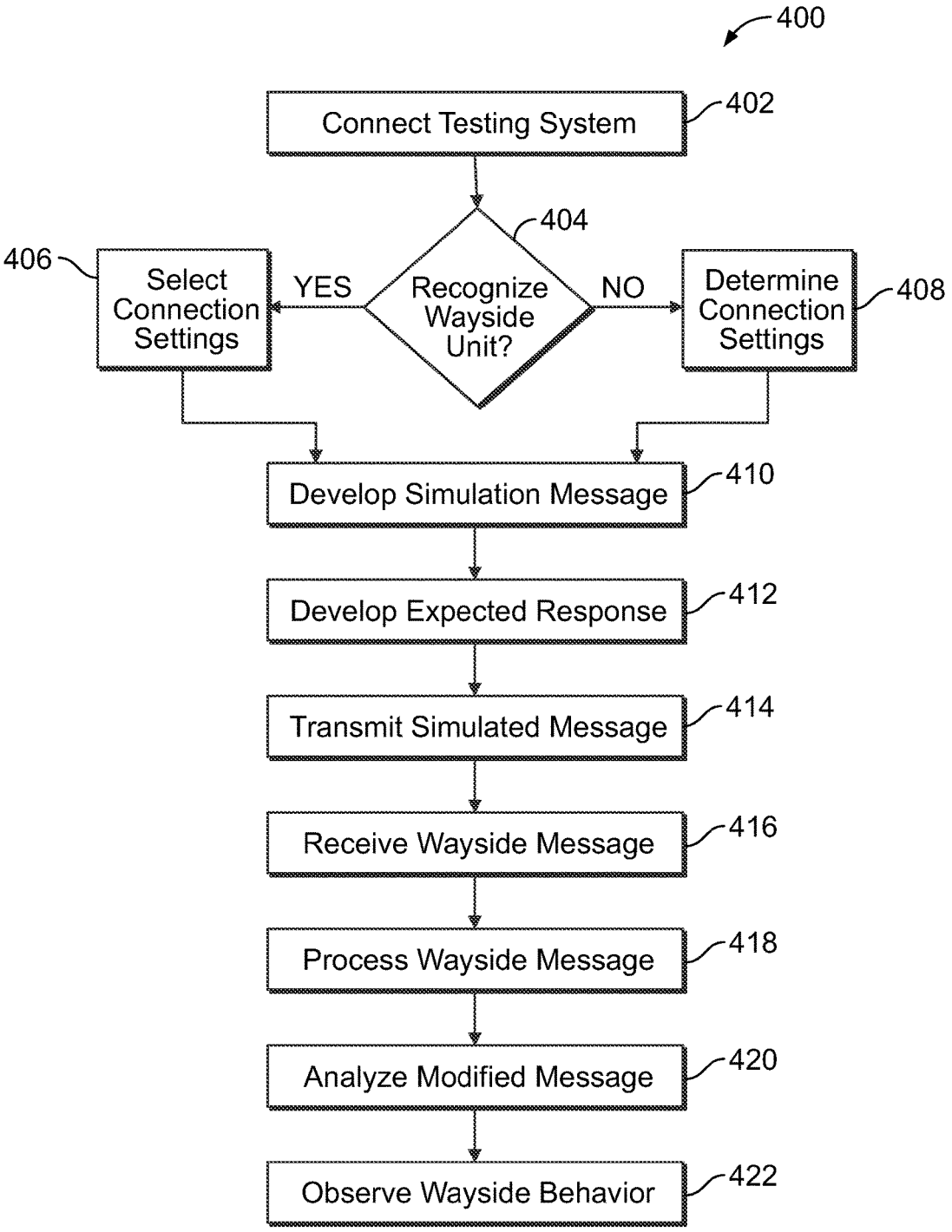
FIG. 4 is a flowchart of an embodiment for testing a wayside unit.

FIG. 4 is a flowchart of an embodiment for testing a wayside unit. The method 400 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 402, a testing system is connected to a wayside unit to be tested. The testing system, for example, may be configured as a PC such as a laptop, or may reside in or as a part of a PC such as a laptop. The testing system, in various embodiments, may be connected to the wayside unit via a hard-wired link or via a wireless link. In some embodiments, the testing system may be connected to the wayside unit remotely. The testing system may be connected to the wayside unit on-site (e.g., with the wayside unit installed in the field), or may be connected to the wayside unit off-site (e.g., in a lab or shop). The testing system may be used to one or more approve a wayside unit for use pre-installation, to perform periodic testing or evaluation, or to troubleshoot a wayside unit identified as functioning other than as intended. The connection of the testing system to the wayside unit may be guided or facilitated by a set-up module (e.g., a set-up module of the testing system) configured to ensure that the correct settings are used, as discussed herein.

At 404 it is determined if the testing system recognizes the wayside unit. For example, a set-up module of the testing system may analyze identification information of the wayside unit and determine if connection settings for use with the particular wayside unit are available to or accessible by the testing system. If the wayside unit is recognized, the method proceeds to 406, but if the wayside unit is not recognized the method proceeds to 408.

At 406, if the wayside unit is recognized, connection settings for the particular wayside unit are selected (e.g., selected autonomously by a set-up and/or connection module of the testing module) and used to connect the wayside unit. The connection settings may include, in some embodiments, information describing a specific mapping file used to format or organize messages for communication with the particular wayside unit. The setting used may be recognized autonomously by the testing system (e.g., via recognition of a name, code, or unique identifier for the wayside unit), or, as another example, may be entered by an operator (e.g., by selection from settings for plural wayside units presented as a list such as a pull-down menu).

At 408, if the wayside unit was not recognized, the proper connection settings are determined and entered. The connection or set-up procedure may be guided by a set-up module of the testing system. Once the connection settings are finalized, the settings may be saved and identified as corresponding to the particular wayside unit for later reference (e.g., subsequent testing performed at a later time). Thus, after an initial set-up procedure, if the particular wayside unit is to be tested, the set-up procedure may be skipped or streamlined for later tests.

At 410, a simulated message is developed. The simulated message is configured to be transmitted by the testing system to the wayside unit. The simulated message is developed to simulate a message from a vehicle (or other element of a transportation network). The message to be simulated, in various embodiments, is configured to elicit a response (e.g. an acknowledgement or status message) from the wayside unit as well as to direct the wayside unit to perform a wayside activity as described herein or to control the performance of a wayside activity by another component or system, such as a functional system operably connected to the wayside unit. In some embodiments, an operator may specify the content of the simulated message or a task (or tasks) corresponding to the simulated message. Additionally or alternatively, the task or tasks for inclusion in the message may be selected autonomously by the testing unit and/or specified by a predetermined testing protocol. The testing system may construct, develop, organize, and/or format the message using a mapping file configured for the particular wayside unit being tested.

At 412, an expected response is developed. The expected response may be developed by an analysis module of the testing system. The expected response in various embodiments corresponds to the response (e.g., acknowledgment message or status message) that will be sent in response to the simulated message by a wayside unit that is functioning as intended or according to preferred or desired design specifications. The expected response may include information specifying the settings of one or more statuses of wayside unit. The response may include, for example, an identification of one or more statuses or settings. Alternatively or additionally, the response may include all or a portion of a message formatted according to a mapping file. A comparison of an actual response received to the expected response may be used to determine if the wayside unit is functioning as intended and/or to identify any issues with the performance of the wayside unit.

At 414, the simulated message developed at 410 is transmitted from the testing system to the wayside unit. The simulated message may be configured to elicit a response from the wayside unit, such as an acknowledgement or status message. The simulated message may also be configured to direct the performance of (or inhibition of performance of) a task or wayside activity to be performed by the wayside unit or under the control of the wayside unit. For example, the task or wayside activity may correspond to the operation of a crossing warning system, with the task or wayside activity being, for example, one or more of a crossing warning activation (e.g., at a specified time), a crossing warning system inhibit request, a request for release of a vehicle from a station, or the like. In some embodiments, plural simulation messages configured to simulate messages from corresponding plural elements of a transportation network may be sent. The plural simulation messages may be sent concurrently. In various embodiments, the plural simulation messages may be configured, arranged, and/or transmitted using automated message sequencing. The automation of the message sequencing may be, as one example, time based, or, as another example, event based.

At 416, a wayside message is received. The wayside message, for example, may be an acknowledgment or status message transmitted from the wayside unit to the testing system responsive to the simulated message transmitted from the testing system to the wayside unit at 414. The wayside message may specify or correspond to one or more statuses that correspond to settings of the wayside unit. The wayside message may also include additional information, such as location information describing the location of the wayside unit or associated equipment, timing information describing the length of timeout and/or warning periods, or the like.

At 418, the wayside message received at 416 is processed. The wayside message in various embodiments is processed to form a revised or modified message. For example, the wayside message may be processed by a filter module of the testing system. For example, a portion of the wayside message (e.g., a portion not of interest to an analysis or evaluation may be removed). Additionally or alternatively, all or a portion of the wayside message may be translated to a form more easily comprehensible by an operator or user. For example, all or a portion of the wayside message may be translated from a first format (e.g., a format in which the message was transmitted) to a second, more easily understood format (e.g., a plain-language such as English format). Thus, instead of appearing in an original format, a wayside message may be modified to display aspects of interest in a readily understood language or format. By way of example, English language descriptions of various settings or statuses may be included in a modified message.

At 420, the modified message is analyzed. For example, the modified message may be displayed (e.g., on a screen, such as the screen of a laptop) for analysis by a user or operator. Thus, a display corresponding to the wayside message may be generated or provided. Additionally or alternatively, the modified message may be analyzed by the testing module autonomously. For example, the testing module may compare the modified message to an expected message (e.g., an expected response developed at 412). If the modified message matches the expected message, the wayside unit may be considered to have functioned as intended or designed during the particular test for which the messages matched. If the modified message differs from the expected message, the wayside unit may be determined not to have functioned as intended. Differences between the modified message and the expected message may be used to determine or identify issues and/or potential solutions for the wayside unit.

At 422, wayside behavior is observed. For example, it may be noted whether or not an activity is performed (or inhibited from performing) as specified by the simulated message. Wayside behavior may be observed by monitoring the actual performance of an activity (e.g., watching to see if a gate is lowered), or by monitoring an output of the wayside unit corresponding to an activity (e.g., monitoring a signal to be sent to a flashing light to confirm if the signal monitors corresponds to the lights flashing at a specified time). Wayside behavior may be used to confirm an analysis performed by analysis of a wayside message and/or to supplement such an analysis. For example, a wayside message may indicate that the status of a given timer associated with an activity is "on," but may not specify the value of a countdown associated with the time or whether the activity has actually been performed. Actual performance of the activity and/or value of outputs provided by the wayside unit may be monitored to confirm that the timer is actually running, the value of a countdown associated with the timer, and/or the actual time of performance of the activity. By way of example, a status for an activity may be set as "on" or "pending," but if there is a mechanical issue (e.g., a gate that is stuck), the activity may not be performed.

In an embodiment, a system includes a communication module and an analysis module. The communication module is configured to be operably connectable to a wayside unit of a transportation network and to transmit a simulation message to the wayside unit. The simulation message simulates at least one of a request or command from at least one transportation network element corresponding to a wayside action to be performed by the wayside unit. The simulation message is configured to elicit a wayside message from the wayside unit upon receipt (e.g., in response to receipt) of the simulation message. The analysis module is configured to obtain the wayside message and to provide a display corresponding to the wayside message.

In another aspect, the system includes a filter module configured to at least one of remove or modify a portion of the wayside message to be displayed to provide a modified wayside message. The analysis module is configured to provide a display comprising the modified wayside message.

In another aspect, the analysis module is further configured to develop an expected wayside message corresponding to a message expected from the wayside unit when the wayside unit is functioning as intended. The analysis module is further configured to compare at least a portion of the wayside message received from the wayside unit to at least a portion of the expected wayside message. Further, the analysis module is configured to identify a difference between the at least a portion of the wayside message and the at least a portion of the expected wayside message. In some embodiments, the analysis module may be configured to identify an issue or potential problem with the wayside unit based upon the identified difference.

In another aspect, the communication module is configured to transmit plural simulation messages concurrently. The plural simulation messages simulate requests or commands from corresponding plural elements of the transportation network.

In another aspect, the wayside unit is configured as a remote crossing module, and the at least one of the request or command corresponds to a crossing activity.

In another aspect, the system includes a set-up module configured to guide an operator through a set-up procedure for operably connecting the testing system to the wayside unit. The set-up procedure is configured for a particular location for which the wayside unit is intended.

In another aspect, the communication module includes a connection module configured for a hard-wired connection to the wayside unit.

In another aspect, the system includes a hand portable housing, with the communication module and the analysis module being disposed in the hand portable housing, and the analysis module being operatively connected to the communication module. For example, the system may include a personal computer that includes the communication module and the analysis module.

An embodiment relates to a method that includes developing a simulation message configured to simulate at least one of a request or command from at least one transportation network element for a wayside action to be performed by a wayside unit. The simulation message is configured to elicit a wayside message from the wayside unit upon receipt of the simulation message. The method also includes transmitting, from a communication module of a testing system, the simulation message to the wayside unit. Also, the method includes receiving, at the communication module, the wayside message from the wayside unit. Further, the method includes providing or generating a display corresponding to the wayside message.

In one aspect of the method, the method includes filtering at least a portion of the wayside message after receiving the wayside message from the wayside unit to provide a modified message, and displaying the modified message.

In one aspect of the method, the method includes developing, at an analysis module of the testing system, an expected wayside message corresponding to a message expected from the wayside unit when the wayside unit is functioning as intended. The method also includes comparing at least a portion of the wayside message received from the wayside unit to at least a portion of the expected wayside message, and identifying, at the processing unit, a difference between the at least portion of the wayside message and the at least a portion of the expected wayside message.

In one aspect of the method, the method includes transmitting plural simulation messages including the simulation message concurrently. The plural simulation messages simulate at least one of requests or commands from corresponding plural elements of the transportation network.

In one aspect of the method, the wayside unit is configured as a remote crossing module configured to operate crossing equipment (e.g., one or more aspects of a crossing warning system), and the at least one of the request or command corresponds to a crossing activity.

In one aspect of the method, the method includes monitoring a physical activity performed by the wayside unit responsive to the transmitting the simulated message from the communication module of the testing system.

In one aspect of the method, the method includes guiding, with a set-up module of the testing system, an operator through a set-up procedure for operably connecting the testing system to the wayside unit. The set-up procedure is configured for a particular location for which the wayside unit is intended.

In one aspect, a tangible and non-transitory computer readable medium includes one or more computer software modules configured to direct one or more processors to develop a simulation message. The simulation message is configured to simulate at least one of a request or command from at least one transportation network element for a wayside action to be performed by a wayside unit, with the simulation message configured to elicit a wayside message from the wayside unit upon receipt of the simulation message. The one or more computer software modules also are configured to direct the one or more processors to transmit the simulation message to the wayside unit, to receive the wayside message from the wayside unit, and to provide a display corresponding to the wayside message.

In an aspect, the computer readable medium is further configured to direct the one or more processors to filter at least a portion of the wayside message after receiving the wayside message from the wayside unit to provide a modified message; and to display the modified message.

In an aspect, the computer readable medium is further configured to direct the one or more processors to develop an expected wayside message corresponding to a message expected from the wayside unit when the wayside unit is functioning as intended, to compare at least a portion of the wayside message received from the wayside unit to at least a portion of the expected wayside message, and to identify an issue corresponding to a difference between the at least portion of the wayside message and the at least a portion of the expected wayside message.

In an aspect, the computer readable medium is further configured to direct the one or more processors to transmit the simulation message as one of plural simulation messages transmitted concurrently. The plural simulation messages simulate at least one of requests or commands from corresponding plural elements of the transportation network.

In an aspect, the wayside unit is configured as a remote crossing module configured to operate crossing equipment, and the at least one of the request or command corresponds to a crossing activity.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A testing system for testing a wayside unit of a railway transportation network, the testing system comprising:

a communication module configured to be operably connectable to the wayside unit of the transportation network, the wayside unit being arranged to communicate with an on-board system of a vehicle moving on the railway transportation network, to one or more of control the movement of said vehicle or to control equipment associated with a crossing of said transportation network with at least one route of a transportation system, the communication module being configured to transmit a simulation message to the wayside unit, the simulation message being a message configured to appear as emanating from the vehicle and simulating at least one of a request or command from at least one transportation network element corresponding to a wayside action to be performed by the wayside unit, the simulation message being configured to elicit a wayside message from the wayside unit upon receipt of the simulation message; and an analysis module, the analysis module being arranged:

to confirm an action performed by the wayside unit responsive to receipt of the simulated message, to obtain the wayside message, and to provide a display corresponding to the wayside message.

2. The testing system of claim 1, wherein the communication module is configured to transmit the simulation message as one of plural simulation messages, the communication module configured to transmit the plural simulation messages concurrently, the plural simulation messages simulating at least one of requests or commands from corresponding plural elements of the transportation network.

3. The testing system of claim 1, wherein the communication module comprises a connection module configured for at least one of a hard-wired or wireless connection to the wayside unit.

4. The testing system of claim 1, further comprising a hand portable housing, the communication module and the analysis module being disposed in the hand portable housing, and the analysis module being operatively connected to the communication module.

5. A method for testing a wayside unit of a railway transportation network, the method comprising:

developing, with a testing system operably connected to the wayside unit, a simulation message configured to simulate at least one of a request or command from at least one transportation network element for a wayside action to be performed by the wayside unit, the simulation message being a message configured to appear as emanating from a vehicle and being configured to elicit a wayside message from the wayside unit upon receipt of the simulation message, the wayside unit arranged to communicate with an on-board system of the vehicle moving on the railway transportation network to one or more of control the movement of said vehicle or to control equipment associated with a crossing of said transportation network with at least one route of a transportation system;

transmitting, from a communication module of the testing system, the simulation message to the wayside unit;

receiving, at the communication module, the wayside message from the wayside unit;

confirming an action performed by the wayside unit responsive to receipt of the simulated message;

obtaining the wayside message; and generating a display corresponding to the wayside message.

6. The method of claim 5, further comprising transmitting the simulation message as one of plural simulation messages transmitted concurrently, the plural simulation messages simulating at least one of requests or commands from corresponding plural elements of the transportation network.

7. A tangible and non-transitory computer readable medium of a testing system for testing a wayside unit of a railway transportation network, the computer readable medium comprising one or more computer software modules configured to direct one or more processors to:

develop a simulation message configured to simulate at least one of a request or command from at least one transportation network element for a wayside action to be performed by the wayside unit, the wayside unit being arranged to communicate with an on-board system of a vehicle moving on the railway transportation network, to one or more of control the movement of said vehicle or to control equipment associated with a crossing of said transportation network with at least one route of a transportation system, the simulation message being a message configured to appear as emanating from the vehicle and configured to elicit a wayside message from the wayside unit upon receipt of the simulation message;

transmit the simulation message to the wayside unit;

receive the wayside message from the wayside unit;

confirm an action performed by the wayside unit responsive to receipt of the simulated message; and provide a display corresponding to the wayside message.

8. The computer readable medium of claim 7, wherein the computer readable medium is further configured to direct the one or more processors to transmit the simulation message as one of plural simulation messages transmitted concurrently, the plural simulation messages simulating at least one of requests or commands from corresponding plural elements of the transportation network.

* * * * *